United States Patent [19]

Gregory et al.

[11] Patent Number: 4,467,475

[45] Date of Patent: Aug. 28, 1984

[54] UPPER BODY PROTECTOR APPARATUS

[76] Inventors: John R. Gregory, 303 W. 35th St., Suite C, National City, Calif. 92050; Gerald Parks, 8991 W. Layton Ave., Denver, Colo. 80123; John D. Dondero, P.O. Box 1017, Sun Valley, Id. 83353

[21] Appl. No.: 493,736

[22] Filed: May 11, 1983

[51] Int. Cl.[3] ..... A41D 13/00

[52] U.S. Cl. ..... 2/2

[58] Field of Search ..... 2/2, 44, 45, 102

[56] References Cited

U.S. PATENT DOCUMENTS

| | | | |
|---|---|---|---|
| 2,953,789 | 9/1960 | Morgan et al. | 2/2 |
| 3,158,871 | 12/1964 | Morgan | 2/2 |
| 3,431,560 | 3/1969 | Austin | 2/2 |
| 3,528,106 | 9/1970 | Austin | 2/2 |
| 3,867,726 | 2/1975 | Owi et al. | 2/2 |
| 3,981,027 | 9/1976 | Anderson | 2/2 |
| 4,158,242 | 6/1979 | Mitchell | 2/2 |
| 4,320,537 | 3/1982 | Mitchell | 2/2 |
| 4,322,859 | 4/1982 | Mitchell | 2/2 |
| 4,425,667 | 1/1984 | Harrison | 2/2 |

*Primary Examiner*—Louis K. Rimrodt

*Attorney, Agent, or Firm*—John L. Haller

[57] ABSTRACT

The upper body protector comprises a semirigid integral upper body shield having a chest plate portion, a back plate portion and shoulder plate portions, adapted to conformably embrace the chest, back and shoulders, respectively. A pair of shoulder flaps are hingedly connected to the upper body shield so that the shoulder flaps are superposed over the shoulder portions, the shoulder flaps being movable laterally in an arcuate path between an uppermost position and a lowermost position. A shoulder cap or epaulet is hingedly connected to each shoulder flap.

Locking means is associated with the shoulder portions and the shoulder flaps for locking each shoulder flap in a fixed lowermost position so that the force of a downward impact on each shoulder flap is diffused, thereby reducing the force exerted on the wearer's shoulder. Also included is restraining means hingedly interconnecting the shoulder flaps to the shoulder portions for restraining the shoulder flaps and epaulets from pressuring the wearer's shoulder when a shoulder flap is in the uppermost position as a result of a lateral impact. A method of constructing same is also included.

11 Claims, 21 Drawing Figures

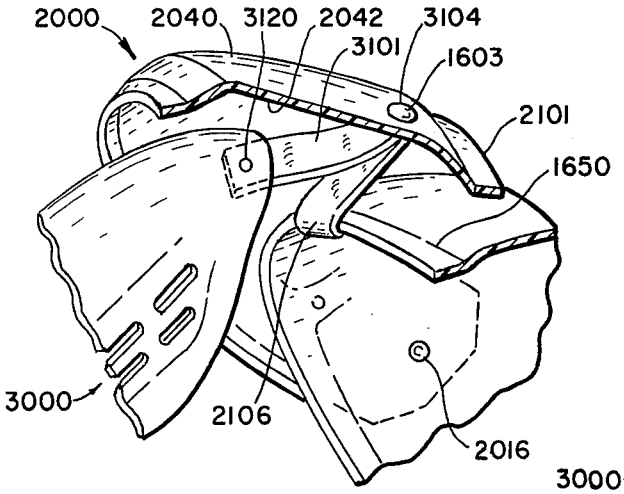
FIG. 11
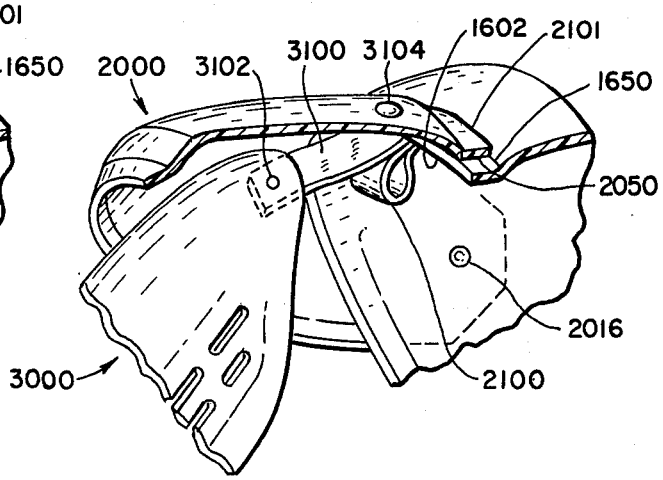
FIG. 12
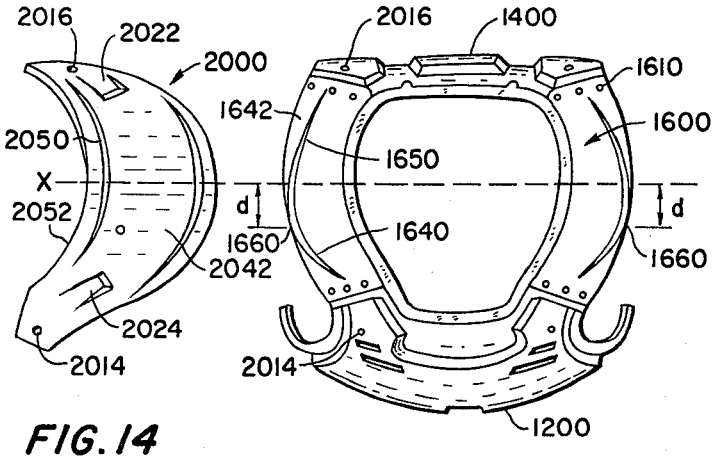
FIG. 14
FIG. 13
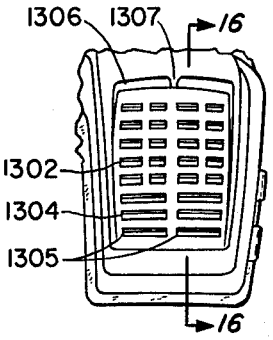
FIG. 15
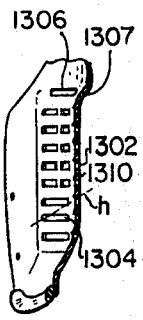
FIG. 16
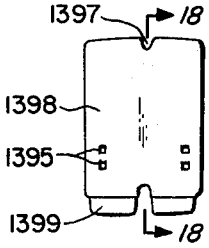
FIG. 17
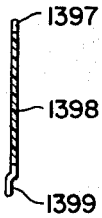
FIG. 18

UPPER BODY PROTECTOR APPARATUS

BACKGROUND OF THE INVENTION

1. Field of the Invention

This invention relates to upper body protectors for athletes, and in particular for athletes engaged in a fast moving sport such as motorcycle riding, bicycle racing, boat racing, hockey, roller derby, and the like.

2. Description of the Prior Art

Conventional upper body protection devices for athletes typically include different configurations and designs for ensuring protection of the athlete's shoulder, chest, and back areas. Many athletic endeavors require upper body protection of the type which could be utilized in motorcycle riding, bicycle riding, boat racing, hockey, roller derby, and the like.

Improvement is always desired from a safety standpoint and is extremely advantageous when the wearer is protected in all aspects of physical contact, including protection from danger of injury from portions of the protective equipment itself. Therefore, it is important in any kind of protective equipment that the structure of same assure that certain types of blows do not cause parts of the protective equipment to endanger the athlete. While the following disclosure relates primarily to motorcycle riding, it will be appreciated by those skilled in the art that the present invention could apply equally well in other sports in which the athlete is exposed to similar types of potential bodily harm.

A particular need for upper body protection is encountered in many sports of the types hereinbefore mentioned, including off-road cross country motorcycle riding and racing, such as motocross. In off-road motorcycle racing competition, there is need to prevent injuries due to accidents, and to protect the rider from rocks, dirt, and other flying debris which is churned up by the racing motorcycle wheels. In the past, a number of structures have been utilized in an attempt to provide protection, including breastplates, chest protectors, clothing made of strong fabric such as leather or other heavy material, and vests. However, all of the above items as found in the prior art provide less than adequate coverage of the critical upper body areas which are desired to be protected.

The types of injuries which may occur in a motocross environment for example, include rocks and other debris being thrown against the body of the rider. The rocks may be in the path of the rider as a result of the rider's own motorcycle, or from the motorcycles travelling ahead of the rider. An even more dangerous situation arises when the rider of the motorcycle has an accident and falls or is thrown from the motorcycle while riding. Particular injuries are especially worrisome such as trauma to the spine or lower back area, which many times is not protected by conventional upper body protection devices.

Aside from the impact to the shoulder and chest area which occurs when the rider falls from a moving motorcycle, there is a serious danger that various protuberances and pieces of the motorcycle itself may impale or strike the rider, such as the handlebars, kickstand, and other portions of the motorcycle forming a sharp or pointed object. A further danger is that the motorcycle rider be injured not only by his own motorcycle, but in a typical racing situation there are also other riders and motorcycles which may cause injury from which the rider must be protected.

Conventional upper body protection equipment utilized include protective wear to be worn under the outer clothing of the athlete, and incorporates a series of layers to provide added protection to the upper body. However, wearing many layers can be burdensome and heavy, and can restrict movement which is very important during the athlete's racing activities.

Numerous devices are available which seek to protect the rider from rocks. However, none of the devices afford adequate protection for the shoulders from the effect of a sudden impact. In most instances, the conventional devices for protection of the athlete's shoulders are capable of being depressed directly against the shoulder upon impact, and do not in any way efficiently and effectively diffuse or disperse the impact to reduce the force of the blow to any particular area of the body.

U.S. Pat. No. 3,867,726 to Owi relates to prior disclosure of a shoulder guard for football players, which includes a shoulder cap or epaulet hingedly attached to a shoulder portion of the device forming a flange pocket to shield the shoulder when a lateral force is exerted against the epaulet. In addition, the front and back body portions are flexibly joined. There is no provision in the prior art for shielding the shoulder from a downward, lateral, or upward force, or for effectively diffusing the force of the impact. Furthermore, there is no provision in the prior art for a unitary solid construction to protect the sternum and spine of the wearer.

U.S. Pat. No. 3,528,106 to Austin relates to prior disclosure of a shoulder guard for football players to restrict downward movement of a shoulder cap or epaulet toward the shoulder of the person wearing the guard, by means of an inner edge of the epaulet seating in a channel of the shoulder portion. The epaulet is fastened directly to the shoulder portion. Similarly, there is no provision in the prior art for unitary construction, or a mechanism for dispersing the impact on the shoulders of the wearer directed from any of a number of different directions.

Other conventional devices in the area of shoulder pad protection as developed for football players include U.S. Pat. No. 3,158,871, U.S. Pat. No. 3,431,560, and U.S. Pat. No. 3,981,027 relating to prior disclosure of shoulder pad constructions. The body protector portions of such devices are formed of flexibly joined front and back body portions to eliminate restriction of movement. In addition, said devices typically attach the shoulder cap or epaulet portion directly to the shoulder portion for protecting the shoulder and the bicep, tricep and deltoid muscular intersection of the upper arm where the humorus is otherwise exposed. Such devices do not provide adequate protection against injuries to the sternum or spine since they are flexibly joined at the areas of the sternum and at the area of the spine, presenting added special dangers of injury from sharp objects of the type encountered by motorcycle riders. Furthermore, such devices do not provide for adequate distribution of an impact to the shoulder area to reduce the force of the impact.

There is no provision in the prior art for lightweight devices which do not impede the movement required in maneuvering the racing equipment, e.g. a motorcycle during a motocross. The bulky type of heavy gear encountered in conventional padding as used in a football player environment is cumbersome and impedes the action of the athlete, such that such equipment is entirely unreasonable to be used in a riding or racing environment. In addition, such devices do not provide the freedom of movement required for negotiating and maneuvering the handlebars of a motorcycle, bicycle, or boat as encountered in a racing competition situation.

Moreover, there is no provision in the prior art for recognizing the problems associated with moving at higher speeds, more than sixty (60) miles per hour in some cases, where efficient air flow and directional air movement is important to the athlete, both in terms of minimizing wind resistance, and providing adequate ventilation. Unlike a football player athlete's environment, an athlete involved in motocross, bicycle racing, boat racing, and the like must remain under physical stress for long periods of time, and is not entitled to a rest after every play, jolt or bump. It must be recognized that the upper body protector must be worn continuously for long periods of time during the race, and withstand constant punishment and stress from flying, debris, heat, sudden impacts, and the like. Therefore, a heavy and bulky upper body protection device is not an appropriate type of construction for use in such an environment.

Moreover, conventional shoulder guard protectors typically utilize a soft outer surface to soften the impact felt by the other players. However, this type of construction has the opposite effect from that desired in a motocross when rocks are hitting the upper body at over sixty (60) miles per hour. A soft surface would tend to absorb the force and momentum associated with the impact of the rock, rather than causing the rock to glance off or be sharply deflected immediately away from the body of the wearer. Also, a soft outer surface would tend to cause rocks and debris to accumulate on the surface, and tend to allow said debris to stick and remain with the rider, which cause extra weight and bulk empeding the rider's movement and causing him to slow down.

Further, such prior art devices are typically constructed of leather or other soft pliable material of bulky size. There is no disclosure in such prior art devices for obtaining maximum strength with minimum weight. Such bulkiness prevents such types of equipment from being appropriate for motorcycle riders. In addition, such equipment has many flaps and interconnections and is not adapted to be worn on the outside of the clothing, but must have an outer protective garment, such as a jersey, to hold the protective equipment in place.

Such prior art shoulder and upper body protection equipment includes complicated reinforced structures which are expensive to manufacture due to increased material requirements and more complex structural interconnections.

Aside from the above mentioned problems of increased manufacturing costs and lack of durability due to the complicated nature of the devices, such conventional upper body protectors are often uncomfortable to the wearer. The neck area many times is sharp and protruding and causes discomfort. Furthermore, the weight of such prior art devices and the body heat generated beneath them due to lack of ventilation is quite undesirable.

Finally, conventional upper body protectors do not provide a sturdy yet convenient device for adequately protecting the upper body from sudden impacts and sharp objects while providing maximum strength, protection, and comfort, with minimum weight.

SUMMARY OF THE INVENTION

It is an object of the present invention to construct an upper body protector which allows for maximum freedom of movement for the wearer thereof.

It is another object of the present invention to construct an upper body protector having a locking shoulder mechanism which diffuses an impact to the shoulder area from any direction, upward, downward, and laterally, to evenly distribute the impact to help reduce the force of impact and minimize the possible trauma and injury resulting therefrom.

It is another object of the present invention to construct an upper body protector which protects the upper body from flying debris and other materials typically encountered by the athlete during competition at high speeds under various topography, terrain, and riding conditions.

It is yet another object of the present invention to construct an upper body protector which protects the sternum and protects the spinal column of the wearer from sharp blows and impacts due to sharp objects, such as the type that may be encountered during participation in the sport, e.g., kickstands, handlebars, motorcycle parts, tree limbs, fence posts, sharp rocks, and the like.

It is a further object of the present invention to construct an upper body protector which is of sufficient strength to withstand sudden impacts and deflect sharp objects moving at high speeds to provide maximum upper body protection, yet having minimum weight.

It is another object of the present invention to construct an upper body protector which provides maximum ventilation and air flow for the wearer thereof.

It is an object of the present invention to construct an upper body protector which offers minimum additional wind resistance to the wearer thereof when moving at high speeds as in a racing or similar environment.

It is yet another object of the present invention to construct an upper body protector which is comfortable to wear for extended periods of time and present minimum chafing or other body discomfort.

It is another object of the present invention to construct an upper body protector which may be worn on the outside of the wearer's clothing such that it is readily adapted to be easily worn and removed with minimum inconvenience, or may be worn under the wearer's clothing.

Another object of the present invention is to construct an upper body protector which provides increased upper torso coverage in the front body portion, and in the back body portion, and which also provides additional protection for the lower back area.

It is another object of the present invention to construct an upper body protector which is convenient to use, yet offers improved durability and reliability.

A further object of the present invention is to construct an upper body protector which is simple and efficient to manufacture at reduced cost.

It is yet another object of the present invention to construct an upper body protector which has a less bulky and more complimentary appearance, and which is aesthetically appealing to the eye.

Further objects of the invention will become apparent in the full description of the invention taken in conjunction with the drawings set forth below.

The upper body protector comprises a semirigid integral upper body shield having a chest plate portion, a back plate portion and a shoulder plate portion, each portion adapted to conformably embrace the chest, back, and shoulder, respectively. A shoulder flap is hingedly connected to the upper body shield so that the shoulder flap is superposed over the shoulder portion, the shoulder flap being movable laterally in an arcuate path between an uppermost position and a lowermost position. A shoulder cap or epaulet is hingedly connected to the shoulder flap.

Locking means is associated with the shoulder portion and the shoulder flap for locking the shoulder flap in a fixed lowermost position so that the force of a downward impact on the shoulder flap is diffused, thereby reducing the force exerted on the wearer's shoulder. Also included is restraining means hingedly interconnecting the shoulder flap to the shoulder portion for restraining the shoulder flap and epaulet from pressuring the wearer's shoulder when the shoulder flap is in the uppermost position as a result of a lateral impact.

In a preferred embodiment of the invention, the locking means includes the shoulder flap having a ridge, and the shoulder portion having an abutment for engaging the ridge when the shoulder flap is in the lowermost position. The restraining means includes a webbing connector fixed in place on the underside of the shoulder flap, the webbing connector being of a predetermined length so that the shoulder flap is restrained from impacting the shoulder portion when the shoulder flap is in the uppermost position. The shoulder flap may be connected by means of rivets, and the webbing connector may be fixed in position by means of stitching and rivets.

Another embodiment includes the back plate portion having a longitudinally extending solid central portion adapted to cover the spine of the wearer. The chest plate portion has reinforced ribbing of varying thickness to reinforce strength.

The chest plate portion, back plate portion, and epaulet includes louvers having slats to control ventilation and minimize wind resistance, the slats being downwardly sloped inward so that they are in a horizontal position when the wearer leans forward while riding a motorcycle.

The epaulet is hingedly connected to the shoulder flap forwardly of the transverse medial axis of the shoulder flap so that the epaulet protects the shoulder and front portion of the arm of the wearer.

A method of constructing an upper body protector is included which comprises molding a semirigid integral upper body shield having a chest plate portion, a back plate portion, and a shoulder plate portion, hingedly connecting a shoulder flap to the upper body shield so that the shoulder flap is movable in an arcuate path between an uppermost position and a lowermost position, and hingedly connecting a shoulder cap or epaulet to the shoulder flap. The shoulder flap is molded having a ridge, and the shoulder portion is molded having an abutment for engaging the ridge when the shoulder flap is in the lowermost position. A preferred method of forming the upper body shield and the epaulet is by injection molding. Padding is adhered to the inner surfaces of the upper body shield, and foam is molded and attached to the neck roll to provide edge padding therefor.

BRIEF DESCRIPTION OF THE DRAWINGS

FIG. 11 is a diagrammatic front perspective view of the embodiment shown in FIG. 1 illustrating the shoulder flap is in an uppermost position.

FIG. 12 is a diagrammatic partially cutaway front perspective view of the apparatus shown in FIG. 1 illustrating the shoulder flap in a lowermost position.

FIG. 13 is a diagrammatic top view of the embodiment shown in FIG. 1, with the shoulder flap and epaulet having been removed.

FIG. 14 is a bottom view of a shoulder flap as shown in FIG. 11.

FIG. 15 is a partially cutaway front view of the embodiment shown in FIG. 1 illustrating a louver configuration.

FIG. 16 is a sectional view along line 15—15 of the embodiment shown in FIG. 15.

FIG. 17 is a front view of one embodiment of a lower cover in accordance with the present invention.

FIG. 18 is a sectional side view of the cover shown in FIG. 17.

DETAILED DESCRIPTION OF THE DRAWINGS

Figure 1:
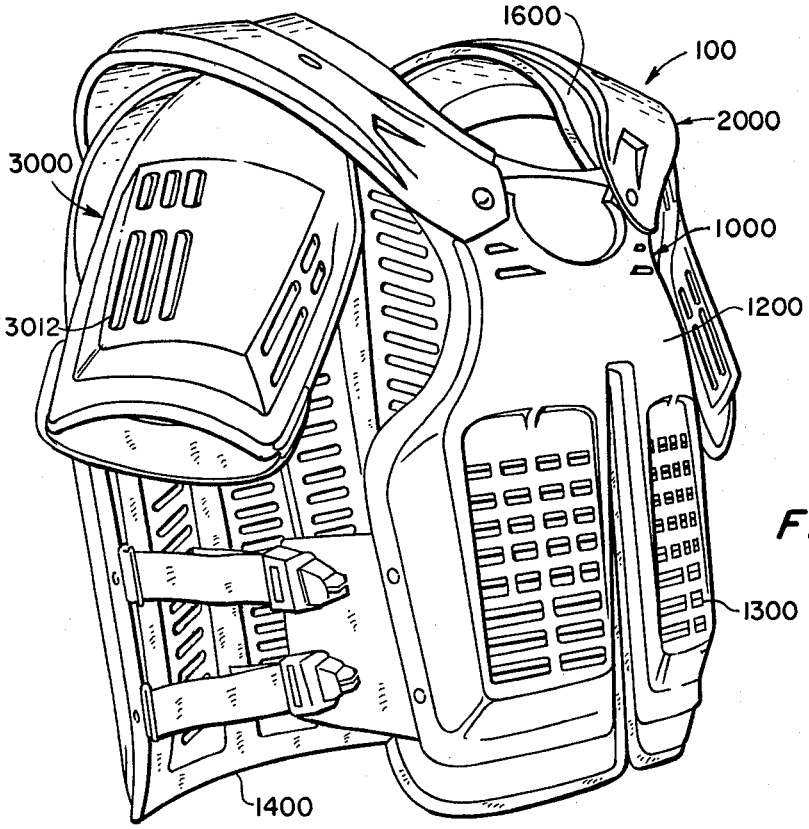
FIG. 1 is a perspective front view of a preferred embodiment of an upper body protector in accordance with the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Referring to the drawings, in FIGS. 1–16 there is shown an upper body protector 100 comprising an upper body shield 1000, a pair of shoulder flaps 2000, and a pair of shoulder caps or epaulets 3000.

Figure 2:
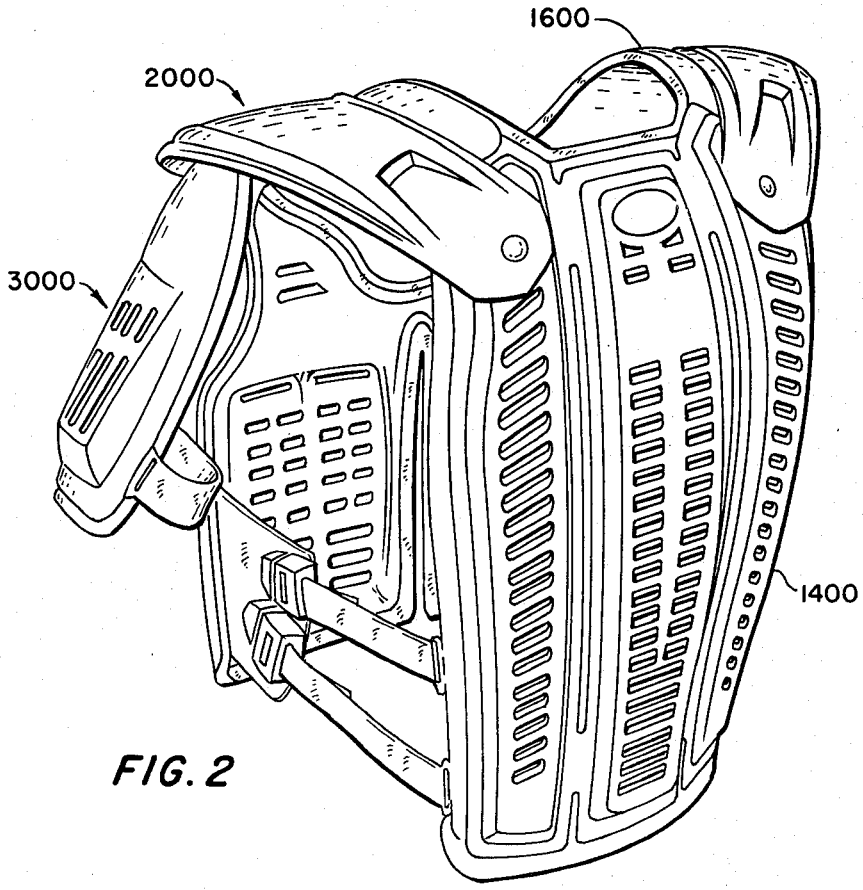
FIG. 2 is a perspective rear view of the embodiment shown in FIG. 1.

The upper body shield 1000 has a chest plate portion 1200, a back plate portion 1400, and a shoulder plate portion 1600, as illustrated in FIGS. 1 and 2. The upper body shield 1000 is made of a semirigid material such as polyethylene or other suitable lightweight strong plastic. The chest plate portion 1200, the back plate portion 1400, and the shoulder portion 1600, are each adapted to conformably embrace the chest, back, and shoulders, respectively, of the wearer. The upper body shield 1000 is preferably an integral element being of substantially one piece construction. The chest plate portion 1200, back plate portion 1400, and shoulder portion 1600 are rigidly secured together to form a substantially U-shaped vertical section thereby conformably embracing the upper torso, and providing a shield for the breast, ribcage, and clavicular area in front of the wearer, and for protection of the shoulder blades, rib area, spine, and lower back area on the back of the wearer.

Figure 3:
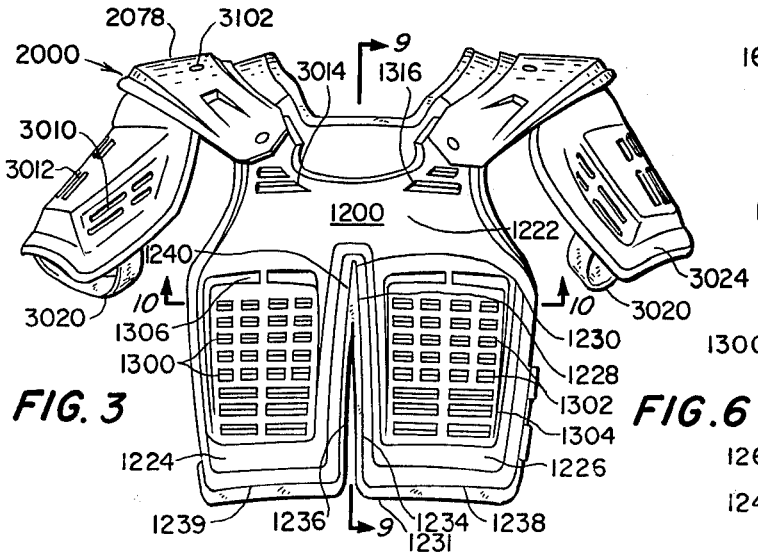
FIG. 3 is a front view of the embodiment shown in FIG. 1.
Figure 6:
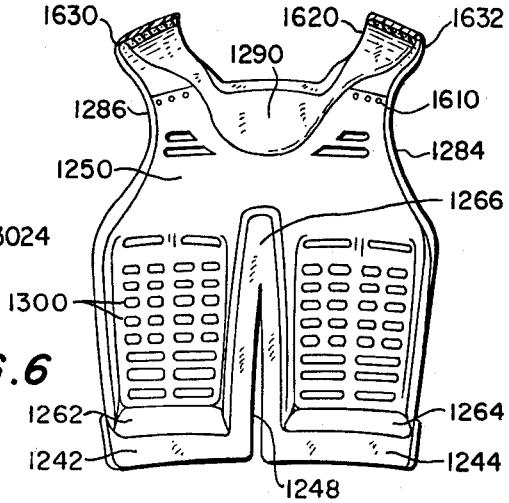
FIG. 6 is a cutaway view of the inside of the chest plate portion of the embodiment shown in FIG. 1.
Figure 10:
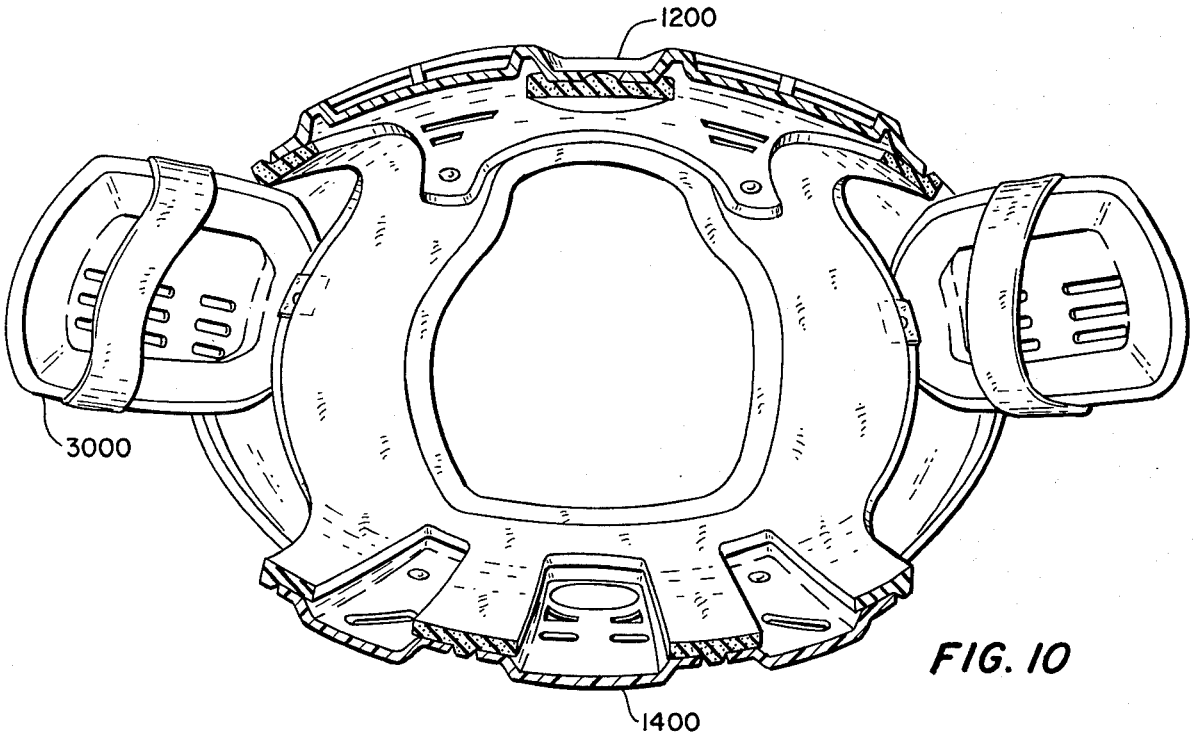
FIG. 10 is a sectional view along line 10—10 of the embodiment shown in FIG. 3.

Chest plate portion 1200, as shown in FIG. 3, comprises a rigid breast plate member 1222 which is of solid construction and is preferably formed of plastic material having suitable flexibility yet possessing sufficient rigidity to withstand shocks or substantial force. The solid construction provides maximum protection for the sternum and upper breast area encasing the heart and other vital internal organs. The chest plate portion 1200, has lower protective members 1224 and 1226 situated over, and to protect, the left and right front ribcage areas, respectively. A central slit 1228 is provided forming an inverted "V" shape separation having its apex 1230 at approximately the lower termination point of the sternum of the wearer. The slit extends from approximately one-half to three-fourths, and preferably about two-thirds, of the way up from the bottom 1231 of the chest plate portion 1200. Approximately ½ of the way up from the bottom 1231 of the chest plate portion 1200, and approximately ⅔ of the way up from the bottom of the slit 1228, there is included padding 1240 which covers the upper ⅓, approximately, of the slit 1228. The padding 1240 extends along the left side member 1234 and the right side member 1236 forming the "V" shaped slit 1228. As best shown in FIG. 6 along with FIG. 3, the padding 1240 has portions 1242, 1244 which extend further around the left bottom portion 1238 and right bottom portion 1239 of the chest plate portion 1200. The padding 1240 comprises a soft yet resilient material which is adhered preferably to the back side 1250 of the chest plate portion 1200, as also shown in FIG. 6.

As further shown in FIGS. 6, the padding 1240 is securely attached along the lower inside edges 1262 and 1264 of the chest plate portion 1200. There is padding portion 1266 securely fastened on either side of the slit 1228 thereby providing an additional solid padding cover over the lower sternum and solar plexus. A slit 1248 in the padding itself permits increased freedom of movement for the wearer while turning on the motorcycle, and allows increased airflow.

Figure 7:
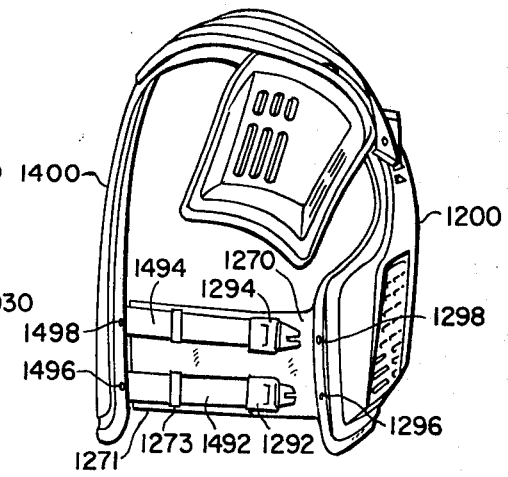
FIG. 7 is a side view of the embodiment shown in FIG. 1 including a side panel.

A lower side member 1270 is attached, as shown in FIG. 7, for providing a securing or fastening member 1292 for holding the chest plate portion firmly on the torso of the wearer.

As best shown in FIGS. 15 and 16, a number of louvers 1300 are in a pattern generally forming a square on the left and right sides of the front of chest plate portion 1200. The louvers are generally shown as being of rectangular shape. Preferably a bank of smaller louvers 1302 are included forming a pattern for maximizing air flow. A series of more elongated rectangular louvers 1304 are included beneath the bank of smaller louvers 1302. In addition, upper louvers 1306 are included immediately below the breast plate portion 1222 of the chest plate portion 1200. As further shown in FIG. 16, the louvers 1302, 1304 are sloped downwardly inward by means of slats or fins 1310.

Conventional louvers are normally sloped downwardly outward in order to repel water and the like. However, in the present invention, the slats 1310 are sloped downwardly inward in order to permit the entry of air. This is very important since maximum ventilation is a critical aspect of athletic competition since the body temperatures during athletic competition, and especially during motorcycle racing, become extremely high. In addition, the racing and riding conditions are such that the upper body protector must be worn for long periods of time under extreme physical conditions such that prevention of excess build up of body heat is critical. Furthermore, by sloping the fins or slats 1310 as disclosed herein, maximum air ventilation is achieved. This is because when the wearer is in the riding mode, typically there is a leaning forward of the wearer such that the axis "h" of each fin 1310 is in a horizontal or other position parallel to the direction of travel of the wearer on the motorcycle, or other vehicle. At high speeds, such as in excess of 60 miles per hour, by the positioning of the slats parallel to the direction of travel, the surface area of the louvers is minimized, thereby minimizing the resistance of the upper body protector to wind, and allowing maximum airflow and air intake through the louvers 1300 in the chest plate portion 1200. Upper louvers 1306 do not have a downwardly inwardly sloping fin section, but serve as outlets for air moving through the chest plate portion onto the wearer's chest area. Additional louvers 1314, 1316 located on the breast plate member 1222 above the upper louvers 1306, provide additional ventilation and minimal wind resistance, as shown in FIG. 3.

An additional feature is a cover 1398 of suitable material, such as plastic, as shown in FIGS. 17 and 18, which is of a corresponding shape and dimension to permit a press fit. The cover 1398 has a pair of tabs 1399 which fit into the two lower most louvers 1305 as shown in FIG. 15, and a slot 1397 which fits over rib 1307 also shown in FIGS. 15 and 16, to securely hold the cover 1398 in place. Removal means 1395, such as finger holes, are included to permit removal of the cover 1398. This permits the wearer to snap the cover 1398 over the louvers 1300 to prevent movement of air in cold weather.

Figure 9:
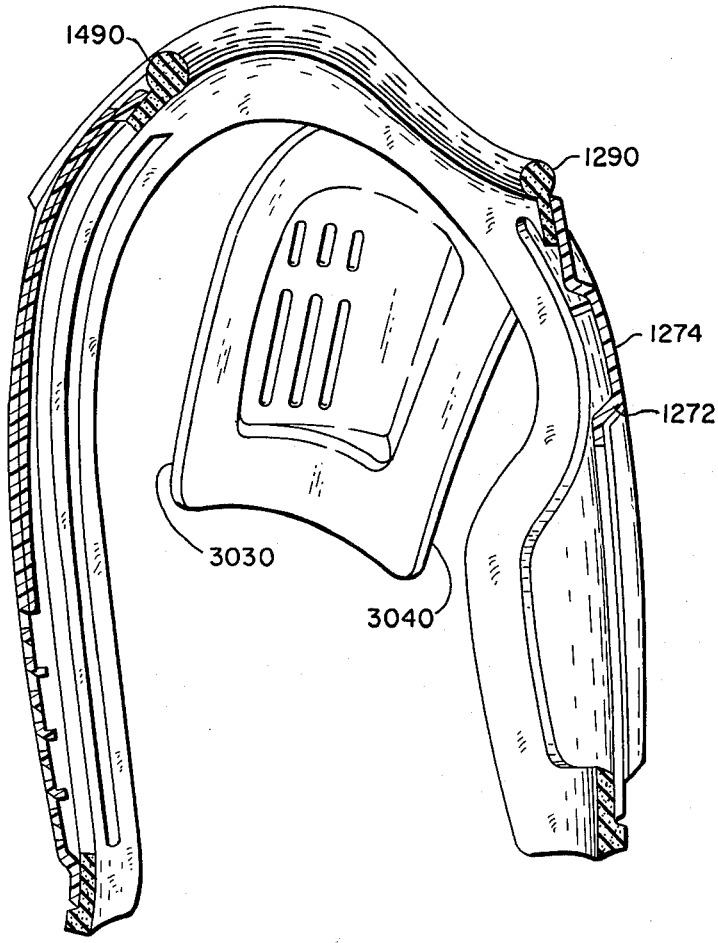
FIG. 9 is a sectional view along line 9—9 of the embodiment shown in FIG. 3.

The structure of the breast plate portion includes shaped raised area 1274 as shown in FIG. 9, and thickness variations 1272 to provide added strength to the lightweight yet solid breast plate member 1222 material.

Figure 5:
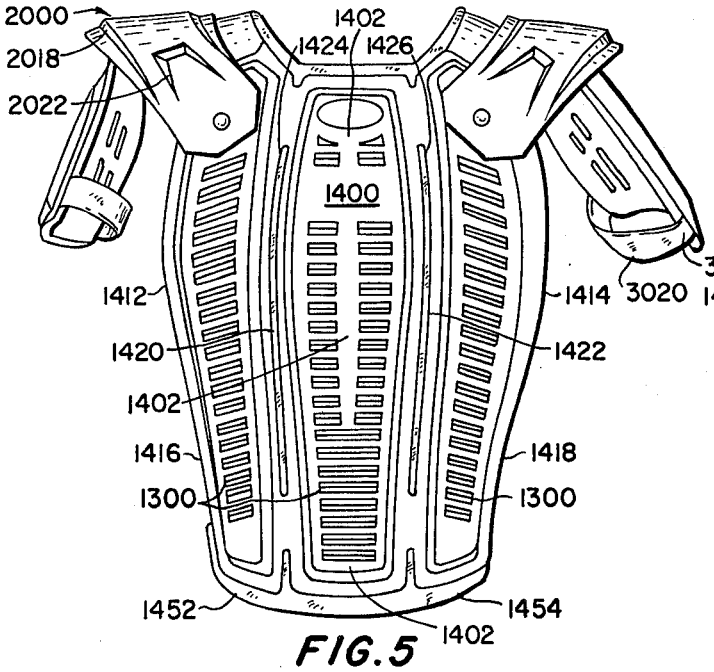
FIG. 5 is a rear view of the embodiment shown in FIG. 1.

Back plate portion 1400, as shown in FIG. 5, is of a substantially one piece construction. Longitudinally extending solid portion 1402 extends the length of the central area and is adapted to cover the spine of the wearer. There is no flexibly joined section as is disclosed in conventional protectors. By making the central portion essentially a solid one piece construction which is unarticulated, there is reduced the probability of a back injury to the spine from sharp or hard objects typically encountered in motorcycle racing. While the solid central portion is essentially solid in the sense that it has no crease of slit through which an object may pass, louvers 1300 are included. Similar to the louvers in the breast plate portion, the back plate portion louvers 1300 are sloped downwardly inward to minimize wind resistance and maximize air ventilation to the wearer when in the riding position.

Figure 8:
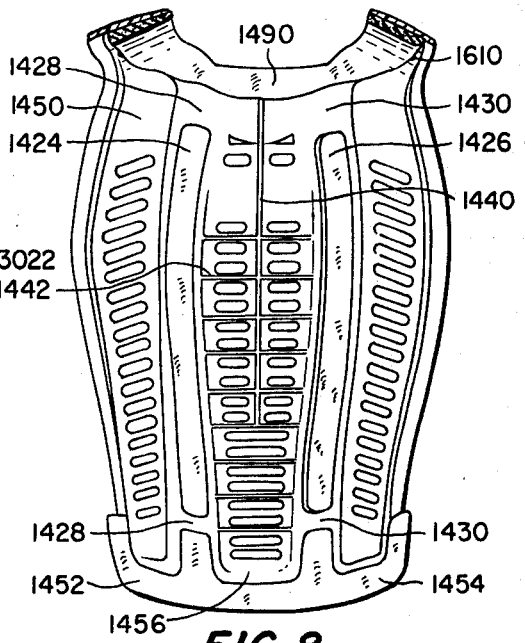
FIG. 8 is a cutaway view of the inside of the back plate portion of the embodiment shown in FIG. 1.

In a preferred construction of the back plate portion 1400, it is shaped to conformably embrace the back of the wearer, and has larger width dimensions at the upper back portion 1412, 1414 than at the lower back area 1416, 1418. Slits 1420, 1422 which are longitudinally extending parallel to the spine may be provided. The slits 1420, 1422 are long and narrow and provide flexibility, yet without the drawbacks of an articulated element. The slits are covered with padding 1424, 1426 which is attached from the inside 1450 of the back plate portion 1400 as shown in FIG. 8. Additional padding 1452, 1454 is provided at the lower portion 1456 of the back plate portion 1400. It is affixed by conventional means such as glue or other conventional method of securing the padding thereto.

The padding material, which may be the same preferably throughout the apparatus, is a shock absorbing type material which is soft yet resilient and provides added comfort to the wearer. It may comprise polyethylene foam contained in a strong yet pliant fabric which is then attached to the back plate portion. The padding 1424, 1426 is secured along an inwardly extending member 1428, 1430, as further illustrated in FIG. 4. Likewise, the breast plate portion padding 1266 is attached along an inwardly bulging or convex member 1280 of the breast plate portion 1200, as also shown in FIG. 4.

Figure 4:
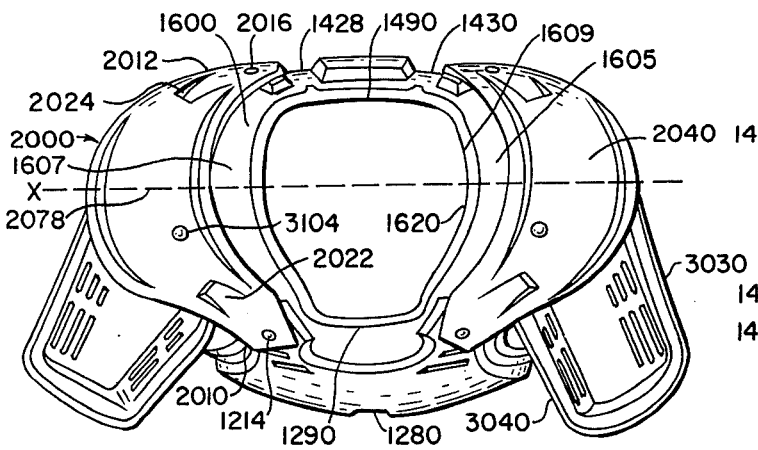
FIG. 4 is a top view of the embodiment shown in FIG. 1.

The shoulder portion 1600 is a generally U-shaped portion having left shoulder portion 1605 and right shoulder portion 1607 adapted to conformably embrace the left and right shoulders, respectively, of the wearer, as shown in FIG. 4. In the description with respect to the shoulder portion, reference will be made to the shoulder portion 1600, which refers and applies equally to left and right shoulder portions 1605 and 1607. It is rigidly connected to the chest plate portion 1200 and the back plate portion 1400 by a rigid solid connection, thereby forming an integral one piece upper body shield. The chest plate portion, back plate portion, and shoulder portion may be formed by a one piece mold, such as by convention plastic injection molding processes. Another suitable method of integrally forming the upper body shield is to attach the shoulder plate portion by means of rivets 1610 as shown in FIG. 13.

As best shown in FIGS. 4 and 6 shoulder portion 1600 is preferably made of the same material as the back plate portion and front plate portion, preferably a plastic material having suitable flexibility yet possessing sufficient rigidity to withstand shocks or substantial force. Neck roll padding 1620 is secured and affixed to the inner perimeter 1609 of the shoulder portion, the inner portion 1490 of the back plate portion 1400, and the inner portion 1290 of the chest plate portion 1200. The chest plate portion 1200 curves inwardly toward the slit 1228 in upper shoulder areas 1284, 1286, as shown in FIG. 6. The shoulder portion 1600 located above shoulder areas 1284, 1286 curves outwardly at areas 1630, 1632 to cover and protect the upper portion of the shoulders, i.e. the clavicular area as well as the scapula. The neck roll padding 1620 may comprise molded foam and adds added protection and comfort, as previously discussed.

As illustrated in FIGS. 1, 2 and 7, the back plate portion 1400 may include side straps 1492, 1494 on the lower outer edge thereof which may be fastened by means of conventional fastening members 1292, 1294, shown as buckles, carried on edge flap 1270 connected to chest plate portion 1200. The webbing connectors 1492, 1494 may be attached by any suitable means, which may include stitching and riveting or other appropriate conventional expedient for interconnection between the elements described above. The interconnections 1496, 1498 include buckles and rivets on the back plate portion 1400. The flap 1270 may be connected to front plate portion 1200 by means of rivets 1296, 1298. While FIGS. 1 and 2 show one embodiment of the edge flap 1270, FIG. 7 includes a side panel portion 1271 connected to edge flap, 1270, and is preferably integral with edge flap 1270, which extends from chest plate portion 1200 to back plate portion 1400 to entirely cover the side of the wearer for added protection. A pair of loops 1273 may be attached to the side panel portion 1271 through which the connectors 1492, 1494 may pass before being fastened at members 1292, 1294.

Further with respect to the back plate portion 1400, as illustrated in FIG. 8, the rear portion 1450 of the back plate portion includes ribbing 1440 vertically extending along the central portion of the inside 1450 of the back plate portion, and includes transverse ribbing 1442 extending parallel in a series of one or more rows extending crosswise down the back plate portion to cover the spine. The ribbing 1440, 1442 provides added strength and stability to the back plate portion and provides improved rigidity for more protection to the spine area, without sacrificing the lightweight qualities which are very important to the present invention.

As best shown in FIGS. 11, 12, 13 and 14, the shoulder flap 2000 is hingedly connected to the upper body shield 1000. A pair of shoulder flaps 2000 are included for the left and right shoulder respectively, and the description hereinafter will be with reference to one of the two flaps, but any description and disclosure therewith applies equally to the other corresponding shoulder flap located directly opposite the one to be described. The shoulder flap 2000 has a generally U-shaped cross section and is conformably shaped to be superposed over the shoulder portion 1600.

Shoulder flap 2000 has a front flap portion 2010 and a rear flap portion 2012, as shown in FIG. 4. The front flap portion 2010 is hingedly connected to the chest plate portion 1200 by means of a suitable connector 2014 such as a pin or rivet. The rear plate portion 2012 is connected to the back plate portion 1400 by means of a suitable hinged connector 2016, such as a rivet or pin.

As seen in FIG. 5, the shoulder flap 2000 has variable thickness and contour edge 2018, 2020 to provide added rigidity and strength. In addition, there may be included an indentation 2022 in the front and 2024 in the back for providing added strength to the shoulder flap, and to provide improved wind resistance characteristics. The material used is a stiff flexible plastic material having suitable strength to withstand sharp shocks and falls by the rider from the motorcycle, preferably the same as that used for the entire upper body shield.

The shoulder flap 2000 is superposed over the shoulder portion 1600. The shoulder flap 2000 is moveable laterally in an arcuate path between an uppermost position and a lowermost position. The uppermost position is illustrated in FIG. 11, and the lowermost position is illustrated in FIG. 12, and is more succinctly described hereinbelow.

The shoulder flap 2000 has a top side 2040. The shoulder flap 2000 has an underside 2042. The underside 2042 has a ridge 2050 (see FIG. 14) which extends substantially parallel along the inside edge 2052 of the shoulder flap 2000. The ridge 2050 is a raised portion of the underside of the shoulder flap 2000 suitable for abutting against another surface. The underside of the shoulder flap also includes the underside of the indentations 2022, 2024 which provide added strength and stability to the shoulder flap construction.

As shown in FIG. 13, the shoulder portion 1600 includes a raised abutment portions 1640, 1642 forming an abutment surface 1650. The contour of the abutment 1650 has a shape corresponding to the shape of the ridge 2050 so that the two surfaces provide a matching or locking fit which fits closely together in a corresponding fashion. The abutment is shaped in the form of an arc when viewed from the top as in FIG. 13 generally corresponding the arc shape of the ridge 2050 as shown in FIG. 14. It is to be pointed out that the center 1660 of the arc formed by the top view of the abutment 1650 is at a point which is forwardly a distance of "d" from the medial axis "x" of the upper body shield 1000, as shown in FIG. 13. This particular design feature is important as will be explained later in the operation of the mechanism.

Referring to FIG. 11, a shoulder cap or epaulet 3000 is hingedly connected to the shoulder flap 2000. The epaulet is of a curved or rounded shape adapted to be worn to cover the bicep, tricep and deltoid muscular intersection of the upper arm where the humorus is otherwise exposed. In addition, the epaulet covers the other end of the shoulder, and is of a similar material as the rest of the upper body shield in that it comprises rigid plastic which is lightweight yet sufficiently strong to withstand sharp impact and blows.

The epaulet includes louvers 3010, 3012 which serve to ventilate the upper arm area, as shown in FIGS. 3 and 5. Similar to the louvers utilized in the upper body shield, some of the vents or louvers 3012 are sloped downwardly inward to maximize air ventilation and air flow while minimizing wind resistance of the rider while the rider is in a competitive motorcycle riding position. Strap members 3020 may be included to conformably hold the epaulet in place on the arm of the wearer, as shown in FIG. 3. They comprise elastic or other suitable material and may be attached as by stitching and rivets or other conventional means 3022, as shown in FIG. 5. The end 3024 of the epaulet 3000 is slightly tapered to provide additional means of holding the strap in place while not impeding significant arm movement.

As illustrated in FIGS. 11 and 12, the epaulet 3000 is hingedly connected to the shoulder flap 2000 by means of a flexible webbing connector 3100. The webbing connector 3100 includes any conventional suitable flexible yet strong material which allows a hinged connection between the epaulet 3000 and the shoulder 2000. Suitable connecting means includes connector 3100 being in the form of a strap or strip connected by means of stitching and rivets 3102, 3104 to the epaulet 3000 and shoulder flap 2000 respectively. As shown in FIG. 4, the location of the connecting means 3104, in the form of a rivet, is forwardly of the lateral medial central axis "x", and not on said lateral central axis. Accordingly, the hinged connection is located not on the highest or uppermost portion 2078 of the shoulder flap 2000 as shown in FIG. 3, but is located further down at position 3104 of the shoulder flap 2000. By making the connection in this manner, the epaulets 3000 are located forwardly of the central medium axis as shown in FIGS. 4, 7, 9 and 10. This feature is critical in a motocross racing environment since it is critical that any protection for the upper arm and shoulder be directed to protect from rocks and flying debris and other sources of harm and impact which would be approaching from the front of the wearer when in a motorcycle racing competition environment. Accordingly, the design of the epaulet 3000 is such that when it is worn on the arm, the rearward edge 3030 is located approximately on the central medial axis "x", and the forward edge 3040 is located approximately directly in front of the central axis of the humorus bone of the arm, thereby covering the upper and front position of the upper arm. This provides improved frontal protection.

A restraining means 2100 is connected to the shoulder portion 1600 at attachment member 1602 by conventional means such as a rivet, and at its opposite end at attachment member 1603 to the shoulder flap 2000, as also shown in FIGS. 11 and 12. In a preferred embodiment, the attachment member 1603 can be the same rivet 3104 which is used to attach the connector 3100 holding the epaulet 3000 to the shoulder flap 2000. The restraining means 2100 may comprise a webbing connector 2100 of suitable strength and flexibility. Preferably it may be a strap or strip of strong material that can withstand the force of a sudden blow or impact. The webbing connector 2100 may be attached by conventional means such as stitching and rivets 1602, 1603 as in the preferred embodiment.

In operation, such as when the wearer encounters an obstacle or another source of sudden impact or strinking, a downward impact would be applied to the shoulder flap 2000 first since it is the outermost portion, such as when the wearer hit the ground, if falling from the motorcycle. At that time an extensive downward force would be applied to the shoulder flap 2000. This would cause a pivoting motion of the shoulder flap 2000 laterally through an arc to a lowermost position, as illustrated in FIG. 12. In the lowermost position, due to sudden impact, the ridge 2050 of the shoulder flap 2000 is forced against the abutment 1650 of the shoulder portion 1600, as shown in FIG. 12. Due to the corresponding shape of the ridge 2050 and the abutment 1650 which fit closely together when they are jammed or forced together as by the striking or violent contact or collision or other shock encountered in a motorcycle environment, they are locked together and otherwise made immovable from traveling further in the arc. This puts the shoulder flap in a fixed lowermost position thereby protecting the shoulder area. By the locking action of the ridge 2050 being forced against the abutment 1650, the impact on the shoulder flap 2000 is effectively diffused and dispersed across the surface area of the entire ridge 2050, and onto the pivot points 2014, 2016 on the front chest plate portion 1200 and back plate portion 1400 respectively. This has the effect of effectively reducing the impact at any one point on the wearer, and diffusing the force thereof to provide greater safety.

As further shown in FIG. 12, at that the lowermost portion, the restraining means 2100 is not in operation, but is loosely hanging so as not to impede movement. By providing freedom of motion of the pivoting movement of the shoulder flap in its lateral arc, freedom of movement is maximized so that there is little or no discomfort or other inconvenience to the wearer, yet maximum protection from impact or other violent contact is obtained. Furthermore, if there is any additional impact, force or pulling on the epaulet 3000, such force is transmitted via webbing connector 3100 to the shoulder flap portion 2000, which is then distributed via the locking action just described so as to further disperse and reduce the impact therefrom. A significant advantage of the present invention over the prior art is that the epaulet 3000 is attached to the shoulder flap 2000 in the manner described, rather than having the epaulet 3000 be attached directly to the shoulder portion 1600 as is commonly found in the upper body protection art. Accordingly, the present invention realizes a number of advantages not found or provided for in conventional upper body protectors.

Alternatively, in operation, a sudden impact, striking or violent contact may occur to the wearer of the upper body protector in a direction upward or laterally. This situation is illustrated in FIG. 11 wherein the shoulder flap is in the uppermost position. A lateral or upward force causes the shoulder flap 2000 to move in an arc until the restraining means 2100 is pulled taut between the shoulder portion attachment 1602 and the shoulder flap attachment 1603. The restraining means 2100 is of a predetermined length so that the shoulder flap 2000 is restrained from forcibly impacting the shoulder portion 1600. Accordingly, the restraining means prevents the shoulder flap 2000 from pressuring the wearer's shoulder via the shoulder portion 1600 and holds the shoulder flap 2000 in a position corresponding to the uppermost position. There may be a slight engagement of the shoulder flap 2000 against the shoulder portion 1600 as shown at 2101. However, the restraining action is basically performed by, and the force exerted on, the restraining means 2100, in conjunction with the pivoted connection points 2014, 2016. In addition, if an upward or lateral force is exerted on the epaulet 3000 itself, the webbing connector 3100 is of such a length that an upward movement of the arm of the wearer, and therefore the epaulet 3000, would be retained by the upper surface 3001 of the epaulet striking against the under surface 2042 of the shoulder flap 2000 such that upward motion of the epaulet would be restrained, thereby tending to prevent an injury to the arm of the wearer which otherwise might occur. Furthermore, since the epaulet 3000 is hingedly interconnected forwardly of the transverse medial axis "x" of the shoulder flap 2000, there is increased protection afforded against forward impacts and sharp blows, which impacts are of the type typically encountered in the motocross environment where obstruction and sharp immovable objects are typically encountered.

In constructing the upper body protector disclosed herein, the preferred method is to mold the semirigid upper body shield in the form of a chest plate portion, a back plate portion and shoulder plate portions. A preferred method of molding the same is by injection molding using suitable plastics or other polyethylene materials of suitable strength and rigidity. Furthermore, the shoulder flap and the epaulet are likewise molded, preferably by injection molding. This permits rigid unibody construction, while minimizing the costs of manufacture and assembly.

As previously noted, the construction of this embodiment of the invention permits substantial freedom of movement for the wearer, and provides substantial protection and strength, while maintaining a lightweight construction which is comfortable to wear for extended periods of time. Furthermore added protection is obtained by the rigid one piece unibody construction of the upper body protector portion, and the locking mechanism described, as well as the restraining means, for effectively distributing the force of impact.

Figure 19:
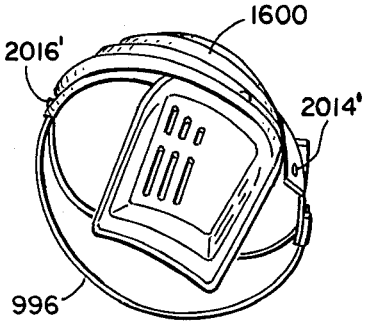
FIG. 19 is a side view of an alternative embodiment comprising a shoulder portion only.
Figure 20:
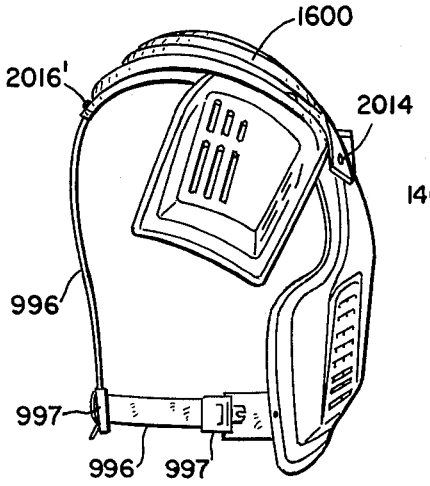
FIG. 20 is a side view of an alternative embodiment comprising a shoulder portion and chest plate portion only.
Figure 21:
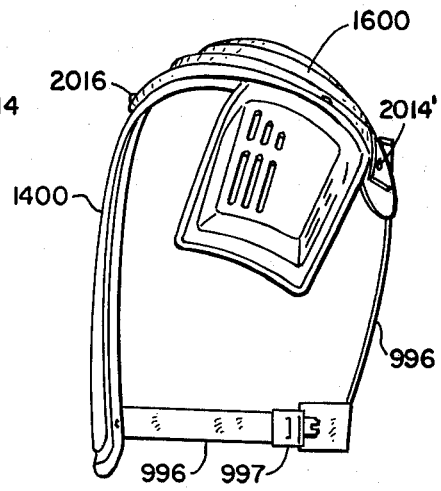
FIG. 21 is a side view of an alternative embodiment comprising a shoulder portion and back plate portion only.

FIGS. 19, 20 and 21 illustrate three alternative embodiments of the locking mechanism in accordance with the present invention comprising a shoulder portion 1600 only, a shoulder portion 1600 and chest plate portion 1200 only, and a shoulder portion 1600 and back plate portion 1400 only, respectively. Conventional means such as straps 996 and buckles 997 are provided to fasten the device securely to the athlete's body.

As also shown in FIG. 19, the shoulder portion 1600 of the alternative embodiment includes a front portion 2014 and back portion 2016' to which front and rear flap portions 2010, 2012 of the shoulder flap 2000 may be pivotally connected, by means of hinged connector 2014 in the front and hinged connector 2016 in the back, preferably in the form of rivets. As shown in FIG. 20, only back portion 2016' is included in the embodiment shown, since the front flap portion 2010 is connected to the chest plate portion 1200. Conversely, as shown in FIG. 21, only the front portion 2014 is included, since the back flap portion 2012 is connected to the back plate portion 1400.

Although the present invention has been shown and described in terms of specific preferred embodiments, it will be appreciated by those skilled in the art that changes or modifications are possible which do not depart from the inventive concepts described and taught herein. Such changes and modifications are deemed to fall within the purview of these inventive concepts. Thus it should be noted that the accompanying description and drawings are meant to describe the preferred embodiments of the invention, but are not intended to limit the spirit and scope thereof.

What is claimed is:

1. An upper body protector comprising:

a semirigid upper body shield having a chest plate portion, a back plate portion, and a main shoulder portion having left and right shoulder portions;

said chest plate portion adapted to conformably embrace the chest of a wearer;

said back plate portion adapted to conformably embrace the ribcage and lower back of the wearer;

said shoulder portion adapted to conformably embrace the shoulders of the wearer;

a pair of shoulder flaps hingedly connected to said upper body shield so that each of said shoulder flaps is superposed over respective left and right shoulder portions, each of said shoulder flaps being movable in an arcuate path between an uppermost position and a lowermost postion;

a pair of epaulets each being hingedly connected, respectively, to said shoulder flaps; and locking means associated with each of said left and right shoulder portions and with each of said respective shoulder flaps for locking each of said shoulder flaps in a fixed position corresponding to said lowermost position so that a downward impact on each of said shoulder flaps is diffused, thereby reducing the force exerted on the shoulder of the wearer as a result of said impact.

2. The apparatus of claim 1, further comprising restraining means hingedly interconnecting each of said shoulder flaps to the respective left and right shoulder portions for restraining each of said shoulder flaps from pressuring the wearer's shoulder when said shoulder flap is in said uppermost position.

3. The apparatus of claim 2, wherein said locking means includes for each of said shoulder flaps, a ridge, and, respective left and right shoulder portions, an abutment for engaging said respective ridge when each of said respective shoulder flaps is in said lowermost position.

4. The apparatus of claim 2, wherein each of said shoulder flap is hingedly connected to said upper body shield by means of rivets.

5. The apparatus of claim 2, wherein said restraining means includes a webbing connector fixed in place on the underside of each of said shoulder flaps, said webbing connector being of a predetermined length so that said respective left and right shoulder flaps is restrained from impacting each of said shoulder portions when each of said shoulder flaps is in said uppermost position.

6. The apparatus of claim 2, wherein each of said epaulets is hingedly connected, respectively, to said shoulder flaps by means of respective webbing connectors fixed in place on the underside of each of said shoulder flap.

7. The apparatus of claims 5 or 6, wherein said respective webbing connectors are fixed in position by means of stitching and rivets.

8. The apparatus of claim 1, wherein said back plate portion includes longitudinally extending solid central portion adapted to cover the spine of the wearer.

9. The apparatus of claim 1, further comprising left and right means for adjustably fastening said back plate portion to said front plate portion so that said apparatus may be securely held in place on the torso of the wearer.

10. The apparatus of claim 9, further comprising adjustable arm straps attached, respectively, to each of said epaulets so that said epaulets may be securely held in place on the respective arms of the wearer.

11. The apparatus of claim 9, wherein said left and right adjustable fastening means comprises, respectively, side panels extending from said chest plate position to said back plate portion to cover the respective sides of the wearer.

* * * * *